US008876367B1

(12) United States Patent
Howe et al.

(10) Patent No.: US 8,876,367 B1
(45) Date of Patent: Nov. 4, 2014

(54) CONTAINER HOLDER FOR MIXERS

(76) Inventors: Harold W. Howe, Butte, MT (US); Todd A. McAdams, Butte, MT (US)

( * ) Notice: Subject to any disclaimer, the term of this patent is extended or adjusted under 35 U.S.C. 154(b) by 325 days.

(21) Appl. No.: 12/924,769

(22) Filed: Oct. 5, 2010

Related U.S. Application Data

(60) Provisional application No. 61/278,257, filed on Oct. 5, 2009.

(51) Int. Cl.
*B01F 11/00* (2006.01)
*B01F 15/00* (2006.01)

(52) U.S. Cl.
CPC ..... *B01F 11/0008* (2013.01); *B01F 15/00733* (2013.01)
USPC ..... 366/210; 366/208; 366/211; 248/316.2; 422/561

(58) Field of Classification Search
CPC ..... B01F 11/0008; B01F 5/00733
USPC ..... 248/649, 310, 316.1–316.7; 366/208–211, 215, 218; 422/561
See application file for complete search history.

(56) References Cited

U.S. PATENT DOCUMENTS

| | | | | |
|---|---|---|---|---|
| 636,265 | A | 11/1899 | Koehler | |
| 856,619 | A | 6/1907 | Camp et al. | |
| 1,068,627 | A * | 7/1913 | Bythiner | 248/310 |
| 3,169,742 | A | 2/1965 | Smith | |
| 4,133,466 | A | 1/1979 | Rosen | |
| 4,623,112 | A | 11/1986 | Olson | |
| 4,971,276 | A | 11/1990 | Tannenbaum | |
| 5,154,380 | A | 10/1992 | Risca | |
| 5,533,700 | A | 7/1996 | Porter | |
| 5,560,578 | A | 10/1996 | Schenken et al. | |
| D414,273 | S | 9/1999 | Smith | |
| 6,508,582 | B2 | 1/2003 | Friedman | |
| 6,673,532 | B2 | 1/2004 | Rao | |
| 6,684,922 | B1 | 2/2004 | Alston et al. | |
| 7,041,493 | B2 | 5/2006 | Rao | |
| 7,182,505 | B2 | 2/2007 | Huckby | |
| 7,188,993 | B1 | 3/2007 | Howe et al. | |
| 2002/0044495 | A1 | 4/2002 | Friedman | |
| 2004/0151064 | A1 | 8/2004 | Yi | |

OTHER PUBLICATIONS

Presens Precision Sensing, SFR Shake Flask Reader, http://www.presens.de, undated, pp. 1-2, PreSens Precision Sensing, Germany.
Sartorius Stedim, Sensolux Shaker Tray, http://www.sartorius-stedim.com, undated, pp. 1-3, Sartorius Stedim, Germany.

* cited by examiner

*Primary Examiner* — Timothy Cleveland
(74) *Attorney, Agent, or Firm* — Robert M Hunter

(57) ABSTRACT

An apparatus and method for use in the biopharmaceutical and chemical industries to facilitate the temporary attachment of standard laboratory glassware to vibratory mixers and other types of aggressive shaking equipment. The container holder couples the entire flask or container to the mixing equipment in a secure fashion. The technology may be used with conventional glass flasks, or with plastic flasks that can be configured for either single-use or multiple-use. The invention allows for single handed, low force insertion of the flaskware as well as the incorporation of sensors into the container holder.

24 Claims, 9 Drawing Sheets

CONTAINER HOLDER FOR MIXERS

CROSS-REFERENCES TO RELATED APPLICATIONS

This application claims the benefit of U.S. Provisional Patent Application No. 61/278,257, filed Oct. 5, 2009, the disclosure of which patent application is incorporated by reference as if fully set forth herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not applicable

BACKGROUND OF THE INVENTION

This invention relates to the field of mixing. In particular, the invention relates to attachment of laboratory flasks, reaction vessels and other containers to mixing devices.

Laboratory flasks are vessels (containers) which fall into the category of laboratory equipment known as glassware. In laboratory and other scientific settings, they are usually referred to simply as flasks. Flasks come in a number of shapes and a wide range of sizes, but a common distinguishing aspect in their shapes is a wider vessel "body" and one (or sometimes more) narrower tubular sections at the top called necks which have an opening at the top. Laboratory flask sizes are specified by the volume they can hold, typically in metric units such as milliliters (mL) or liters (L). Laboratory flasks have traditionally been made of glass, but can also be made of plastic and other materials.

At the opening(s) at top of the neck of some glass flasks such as round-bottom flasks, retorts, or sometimes volumetric flasks, there are outer (or female) tapered (conical) ground glass joints. Some flasks, especially volumetric flasks, come with a stopper or cap for capping the opening at the top of the neck. Such stoppers can be made of glass or plastic. Glass stoppers typically have a matching tapered inner (or male) ground glass joint surface, but often only of stopper quality. Flasks which do not come with such stoppers or caps included may be capped with a rubber bung or cork stopper. Flasks can be used for making solutions or for holding, containing, collecting, or sometimes volumetrically measuring chemicals, samples, solutions, etc. for chemical reactions or other processes such as mixing, heating, cooling, dissolving, precipitation, boiling (as in distillation), or analysis.

An Erlenmeyer flask, commonly known as a conical or E-Spot, is a widely used type of laboratory flask which features a flat, conical body, and a cylindrical neck. It is named after the German chemist Emil Erlenmeyer, who created it in 1861. The Erlenmeyer flask is usually marked on the side (graduated) to indicate the approximate volume of contents, and has a spot of ground glass or enamel where it can be labeled with a pencil. It differs from the beaker in its tapered body and narrow neck. The opening usually has slight rounded lips so that the Erlenmeyer can be easily stoppered using a piece of cotton wool or a rubber stopper. Alternatively, the neck may be fitted with a female ground glass joint to accept a glass stopper. The conical shape allows the contents to be swirled or stirred during an experiment, either by hand or by a shaker table or mixer; the narrow neck keeps the contents from spilling out. The smaller neck also slows evaporative loss better than a bigger neck. The flat bottom of the conical makes it unlikely to tip over and spill.

Mixing in chemistry, biology and biotechnology and other fields require motion during mixing processes. Examples of these processes include aerobic or anaerobic fermentation, cell culture and chemical reactions. For many years, containers such as flasks and test tubes have been used with and secured to these devices. Background art container holders are either incapable of retaining flasks during aggressive agitation or are not designed to hold flasks at all (as is the case in multi-well, small volume holders).

Classically, flasks or other containers have been attached to mixing devices using holders that comprise either resilient members such as elastic bands or springs which act to allow the holder to expand or contract to mate to the container. Other holders have comprised fasteners, such as screws, which require tightening to a specific location or torque. Both of these techniques lack the ability to adequately secure the container during the more aggressive motions of more modern mixing devices, especially those with a vertical mixing component. In these more aggressive devices, the container is not held security by its holder and cessation of the mixing process to repair the problem is required or the container is freed from its holder and may be damaged. Both of these instances are detrimental to the goals of the end user.

Some types of flask holders accommodate the use of non-invasive sensors in agitated flasks, but none of these devices have the advantages of the invention described herein. Coasters have been described which incorporate mechanical, optical or electronic components in a flat disc that is placed underneath the flask retention clamp. These coasters have the significant disadvantages of requiring the purchase of a second component, incompatibility with aggressive vertical shaking motions, and more difficulty in use because of the need to align the coaster and the flask holder properly. In addition, sensor platforms designed to seat on top of orbital agitation devices have been developed. Examples of these systems include the Shake Flask Reader from PreSens Precision Sensing of Regensburg, Germany and the Sensolux® Shaker Tray from Sartorius Stedim Biotech of Aubagne, France. These devices add substantial extra weight to the agitating platforms and they do not accommodate the use of aggressive vertical shaking modes.

The background art is characterized by U.S. Pat. Nos. 636,265; 856,619; 3,169,742; 4,133,466; 4,623,112; 4,971,276; 5,154,380; 5,533,700; 5,560,578; 6,508,582; 6,673,532; 6,684,922; 7,041,493; 7,182,505; 7,188,993 and Des. 414,273; and by U.S. Patent Application Nos. 2002/0044495 and 2004/0151064; the disclosures of which patents and patent applications are incorporated by reference as if fully set forth herein.

BRIEF SUMMARY OF THE INVENTION

As used herein, the following terms and variations thereof have the meanings given below, unless a different meaning is clearly intended by the context in which such term is used.

"A," "an" and "the" and similar referents used herein are to be construed to cover both the singular and the plural unless their usage in context indicates otherwise.

"About" means within ten percent of a recited parameter or measurement, and preferably within five percent of such parameter or measurement.

"Comprise" and variations of the term, such as "comprising" and "comprises," are not intended to exclude other additives, components, integers or steps.

"Container" and "vessel" have the same meaning: "an object that can hold contents."

"Downward" means "toward the base."

"Exemplary," "illustrative," and "preferred" mean "another."

"Flask" means "a container or vessel with a wider body and one (or sometimes more) narrower tubular sections at the top called necks which have an opening at the top."

"Outward" means "away from the center of the base."

In one aspect, the invention is capable of securing a container to a mixing device for the purpose of processing the contents of the container. In illustrative embodiments, the device accepts various sizes of flasks from various manufacturers. Moreover, it is operable with one hand and secures the container in the most aggressive mixing devices. It further provides a means to monitor the contents of the flask in a non-intrusive manner during the mixing process.

Use of the invention can improve the utility of mixing equipment that imparts a relative motion to a reaction vessel. One purpose of the device is to prevent the vessel containing the chemical reaction or microorganism solution from becoming separated or detached from the mixing device. Such mixing devices include but are not limited to vibratory and orbital mixers. In preferred embodiments, the invention accommodates standard flaskware of larger volumes and can accommodate aggressive agitation, especially agitation motions that contain a vertical component.

Another purpose of the invention is to prevent the loss of the chemicals, particles or microorganisms from the mixing container into the atmosphere where they could be potentially harmful. Yet another purpose is to allow easy access to the mixing container for the purpose of sampling, changing the medium or reagents or addition of medium or reagents, etc. Another purpose is to attach various sized containers to the mixing device. In another illustrative embodiment, another purpose is to provide a simple, convenient means to monitor flask contents or environmental conditions by means of non-intrusive sensors.

An object of illustrative embodiments of the present invention is to provide an improved and novel means for securing a container to a mixing device for the purpose of processing and monitoring the contents. In this embodiment, the holding device is intended to secure a wide range of container designs and sizes to an aggressive motion mixer. For example, the invention may be used to secure media bottles (cylindrical containers that biological culture media are stored in) to a mixer.

In an illustrative embodiment, the invention is an apparatus for securing an Erlenmeyer flask to an oscillatory mixer, said apparatus comprising: a base that is adapted for temporary attachment to the oscillatory mixer, said base having a substantially planar upper surface, a plurality of finger attachment points, a plurality of base hold down attachment points, a sensor view port and a front to back symmetry line; a backstop that is fixed to said base; two opposing side fingers, each of said opposing side fingers comprising a side finger snap fit protrusion which is adapted for snapping into said base at either of said finger attachment points that is located nearest to said backstop and each of said opposing side fingers comprising a surface that is disposed substantially parallel to said front to back symmetry line when said two opposing side fingers are attached to said base; a plurality of forward fingers, each of said forward fingers comprising a forward finger snap fit protrusion that is adapted for snapping into said base at another of said finger attachment points; a non-contact sensor that is mounted in said base under said sensor view port; and a sensor interface that is operatively connected to said non-contact sensor and that is mounted on said base. In another embodiment, said opposing side fingers and said forward fingers are interchangeable. In another embodiment, said opposing side fingers and said forward fingers have the same dimensions and shape. In another embodiment, said non-contact sensor is an optical sensor. In another embodiment, said backstop is integral with said base. In another embodiment, said base, said backstop, said two opposing fingers and said forward fingers are fabricated or molded from plastic. In another embodiment, each of said fingers further comprises a substructure and each of said finger attachment points comprises a hole into which one of said snap fit protrusions in snappable and a notch which accommodates said substructure.

In another illustrative embodiment, the invention is a holder for securing a container to a movable surface, said container having a bottom, a round cross section having a largest diameter, a toe and a heel, said holder comprising: a base having a top surface and a front to back symmetry line; a backstop that is attached to said base; two opposing fingers that are attached to said base; and a plurality of forward fingers that are attached to said base; wherein, during the insertion of the container into the holder and said bottom is resting on said backstop and said toe is resting on said top surface, said two opposing fingers impose an insertion force component parallel to said front to back symmetry line that is essentially zero in magnitude when said largest diameter lies between said two opposing fingers and the toe of the container is not pressing against said forward fingers; wherein, during the insertion of the container into the holder and said bottom is resting on said backstop, said insertion force component reaches a maximum magnitude when toe of the container is pressing against said forward fingers; and wherein, during the insertion of the container into the holder and the bottom is resting on said top surface, the heel of the container is pressing against said backstop and the toe of the container is pressing against said forward fingers, said insertion force component is reduced below said maximum magnitude. In another embodiment, said base, said backstop, said two opposing said base, said backstop, said two opposing fingers and said forward fingers are parts of one piece of plastic.

In another illustrative embodiment, the invention is a holder for securing a vessel to a movable surface, said vessel having a bottom, a round cross section having a largest diameter, a toe and a heel and being adapted to contain contents, said holder comprising: a base having a top surface and a front to back symmetry line, said base being adapted to be attached to said movable surface; a backstop that is attached to said base; two opposing fingers that are attached to said base; and a plurality of forward fingers that are attached to said base; wherein said opposing fingers and said forward fingers are adapted to bend outward under an insertion force imposed upon them when the bottom of the vessel is resting on said backstop and the toe of the vessel is pressing against said forward fingers; and wherein each of said opposing fingers and each of said forward fingers has an inwardly inclined tip having a vessel interface surface that is adapted to contact the vessel at a contact point and at an angle of contact and to resist a horizontal component and a vertical component of a total force exerted on said each of said fingers by the vessel, said total force being determined by an acceleration imposed on the vessel and a mass of the vessel and its contents divided by the number of fingers resisting the total force. In another embodiment, said acceleration is in a range from about 5 Gs to about 50 Gs. In another embodiment, said base, said backstop, said two opposing fingers and said forward fingers are parts of one piece of metal. In another embodiment, said base, said backstop, said two opposing fingers and said forward fingers are parts of one piece of plastic.

In another illustrative embodiment, the invention is a kit for securing a vessel to a shaker platform with a flask holder, said kit comprising: one or more bases, each of said one or more bases having a sensor port, at least one base hold down attachment point and a plurality of finger-accepting holes; a backstop that is attached to each of said one or more bases; and a plurality of fingers, each of which fingers comprising a protrusion that is operative to removably snap into one of said finger-accepting holes; wherein, when the flask holder is assembled, said backstop and the fingers are arranged on said base in a substantially oval pattern. In another embodiment, each of said bases is provided with a notch that is adjacent to each of said finger attachment holes and each of said fingers comprises a substructure that slides into one of said notches.

In yet another illustrative embodiment, the invention is an apparatus comprising: a vessel having a bottom and a toe and being adapted to contain contents; a mixer having an oscillating component; and a holder for securing said vessel to said oscillating component, said holder comprising: a base having a top surface and being adapted to be attached to said oscillating component; a backstop that is attached to said base; two side fingers that are attached to said base; and a plurality of forward fingers that are attached to said base; wherein said vessel is insertable into said holder by a user using a hand to place said bottom on said backstop and said toe on said top surface, then by sliding said vessel substantially sideways between said two side fingers until said sliding of said vessel bends at least some of said forward fingers outward, and then by sliding said vessel downward between said backstop and said fingers until said bottom rests on said flat surface. In another embodiment, said hand is a single hand. In another embodiment, said base, said backstop, said two side fingers and said forward fingers are parts of a single piece of plastic or metal. In another embodiment, said fingers have the same configurations and dimensions.

In another illustrative embodiment, the invention is an apparatus for securing a flask to an oscillatory mixer, said apparatus comprising: a base that is adapted for temporary attachment to the oscillatory mixer, said base having a substantially planar upper surface, a plurality of finger attachment points, a plurality of base hold down attachment points, a sensor view port and a front to back symmetry line; a backstop that is fixed to said base; two opposing side fingers, each of said opposing side fingers comprising a side finger snap fit protrusion which is adapted for snapping into said base at either of said finger attachment points that is located nearest to said backstop and each of said opposing side fingers comprising a surface that is disposed substantially parallel to said front to back symmetry line when said two opposing side fingers are attached to said base; and a plurality of forward fingers, each of said forward fingers comprising a forward finger snap fit protrusion that is adapted for snapping into said base at another of said finger attachment points. In another embodiment, the apparatus further comprises: a non-contact sensor that is mounted in said base under said sensor view port. In another embodiment, the apparatus further comprises: a sensor interface that is operatively connected to said non-contact sensor and that is mounted on said base.

In yet another illustrative embodiment, the invention is a method of mixing comprising: snapping two opposing side fingers and one or more forward fingers into a base of a container holder at selected finger attachment points, said base comprising a backstop and having a substantially planar upper surface; securing said container holder to a movable part of a mixer; placing a container having a bottom and a toe in said container holder by placing said bottom on said backstop and said toe on said top surface, then by sliding said container substantially sideways between said two opposing side fingers until said sliding of said container bends said one or more forward fingers outward, and then by sliding said container downward between said backstop and said one or more fingers until said bottom rests on said substantially planar upper surface; and operating said mixer so as to impose an acceleration on said container. In another embodiment, said acceleration is in the range from about 5 Gs to about 50 Gs. In another embodiment, said container is an Erlenmeyer flask. In another embodiment, the method further comprises attaching a sensor to said container holder before initiating said operating step.

In yet another illustrative embodiment, the invention is a method of mixing comprising: a step for snapping two opposing side fingers and one or more forward fingers into a base of a container holder at selected finger attachment points, said base comprising a backstop and having a substantially planar upper surface: a step for securing said container holder to a movable part of a mixer; a step for placing a container having a bottom and a toe in said container holder by placing said bottom on said backstop and said toe on said top surface, then by sliding said container substantially sideways between said two opposing side fingers until said sliding of said container bends said one or more forward fingers outward, and then by sliding said container downward between said backstop and said one or more fingers until said bottom rests on said substantially planar upper surface; and a step for operating said mixer so as to impose an acceleration on said container. In another embodiment, said acceleration is in the range from about 5 Gs to about 50 Gs. In another embodiment, said container is an Erlenmeyer flask. In another embodiment, the method further comprises a step for attaching a sensor to said container holder before initiating said operating step.

Further aspects of the invention will become apparent from consideration of the drawings and the ensuing description of exemplary embodiments of the invention. A person skilled in the art will realize that other embodiments of the invention are possible and that the details of the invention can be modified in a number of respects, all without departing from the concept. Thus, the following drawings and description are to be regarded as illustrative in nature and not restrictive.

BRIEF DESCRIPTION OF THE SEVERAL VIEWS OF THE DRAWINGS

The features of the invention will be better understood by reference to the accompanying drawings which illustrate exemplary embodiments of the invention. In the drawings.

Figure 1:
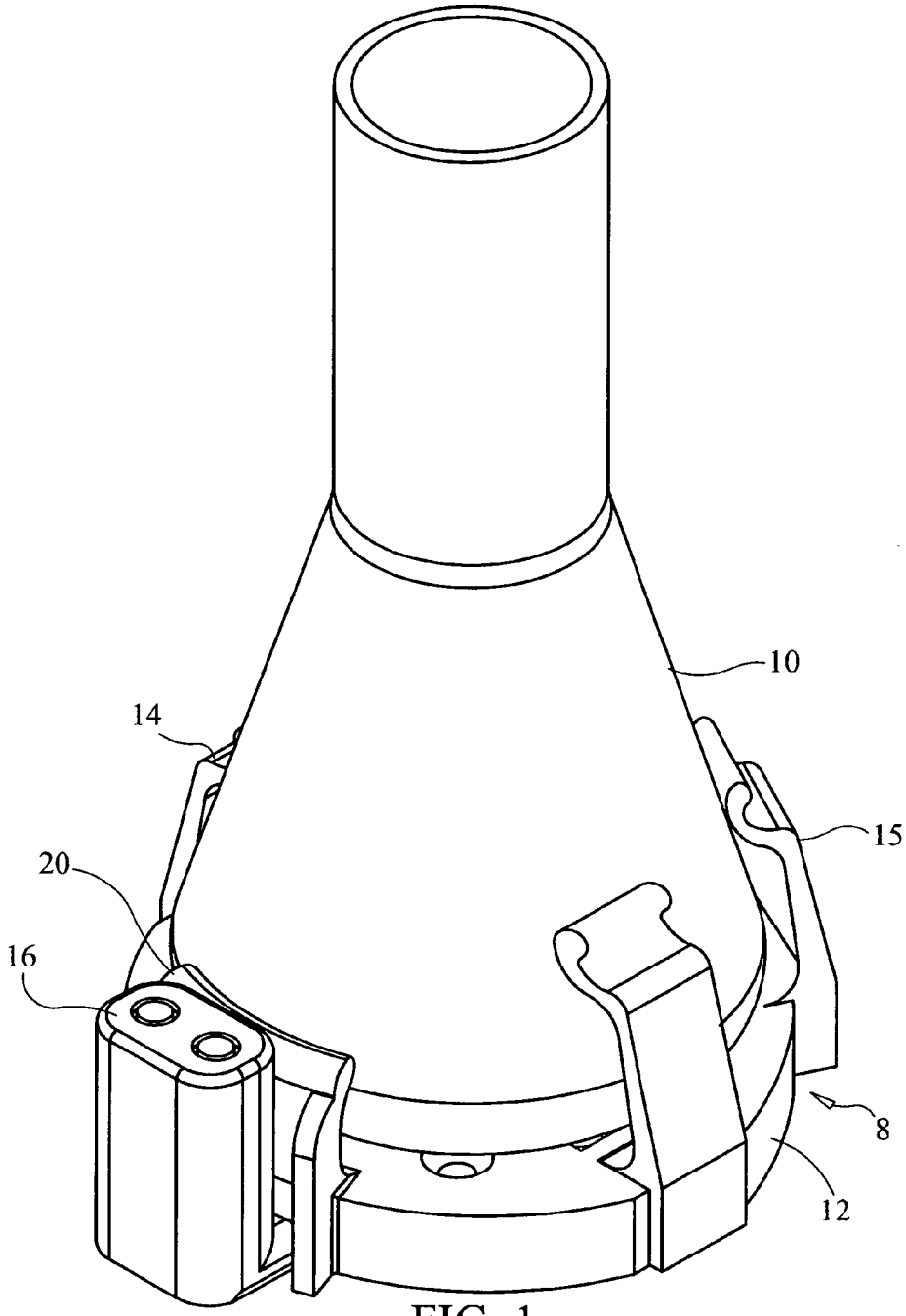
FIG. 1 is a perspective view of a flask secured in a flask holder in accordance with an illustrative embodiment of the invention.

The following reference numerals are used to indicate the parts and environment of an illustrative embodiment invention on the drawings:

8 flask holder assembly, flask holder
10 Erlenmeyer flask, flask, vessel, container
11 toe
12 base
13 heel
14 opposing side fingers, side fingers
15 forward fingers
16 sensor interface
18 non-contact sensor, non-intrusive sensor, sensor element, sensor
19 notch
20 backstop
21 hole
22 finger attachment points
24 base hold down attachment points
26 sensor view port
28 vessel interface surface
30 finger/vessel contact point
32 horizontal force component, horizontal component
34 vertical force component, vertical component
36 front to back symmetry line
38 line
40 snap fit protrusion, protrusion
41 substructure
42 relief slot
50 one-piece metal flask holder
60 one-piece plastic flask holder
70 mixer

DETAILED DESCRIPTION OF THE INVENTION

Referring to FIGS. 1-6, an illustrative embodiment of the invention presented. This embodiment is an apparatus and method for retaining a container 10 (e.g., a laboratory flask) on a mixing device for the purpose of processing the contents of the container. Container retention is superior to that of background art holders in accommodating the higher, more aggressive, mixing motions needed for improved reactions.

In this embodiment, flask holder assembly 8 comprises base 12, backstop 20, opposing side fingers 14 and multiple forward fingers 15. Backstop 20 and fingers 14 and 15 are preferably arranged on base 12 in a roughly (substantially) oval pattern. The pattern and shape of the backstop 20 and fingers 14 and 15 are designed such that the holding force and the insertion forces are optimized for the user and application. In a more preferred embodiment, backstop 20 is permanently fixed to or integral with base 12. In alternative embodiments, backstop 20 is removably attached to (for example, snapped into) base 12.

Insertion of container 10 in flask holder assembly 8 is accomplished by first holding container 10 above the base 20 with its front (leading edge) in a slightly angled down inclination. The front of container 10 becomes the toe 11 and the back becomes the heel 13. Toe 11 is the inserted into the center of base 12 and slid along until the sides of the container encounter opposing side fingers 14. The bottom of container 10 is then brought to rest on the top of backstop 20. Insertion motion then proceeds by sliding the container, toe first, into the device. Insertion forces are first encountered by the action of the container spreading opposing side fingers 14. This force decreases as container 10 progresses into position because it is a result of the curvature of container 10. As container 10 progresses into position, the rate of change of the cord length reduces to zero and the insertion force is at its minimum. Just as the force of insertion due to the opposing side fingers 14 goes to its minimum, container 10 comes into contact with forward fingers 15. This increases the insertion force required to complete the action of container placement. When sufficient forward progress has been achieved, heel 13 is dropped into position behind backstop 20, thus completing the container insertion process. A further refinement may be accomplished by providing a depression in the bottom of base 12. This depression allows the toe 11 or forward portion of container 10 to first proceed into flask holder assembly lower than its floor, thus producing a scooping action to further reduce the insertion force.

It can be appreciated that the design of back stop 20, opposing side fingers 14 and forward fingers 15 may be optimized to accommodate any flask design as well as to produce the required holding force to maintain flask retention at any motion. It may be further appreciated that opposing side fingers 14 accomplish a significant amount of the downward holding force while they produce a minimal insertion force due to their opposing nature.

Referring again to FIGS. 1 and 2, an illustrative embodiment of flask holder assembly 8 is presented. In this embodiment, flask holder assembly 8 comprises base 12, a plurality of fingers 14, 15 and sensor interface 16. In this embodiment, base 12 is provided with finger attachment points 22, each of which includes a notch 19 into which a finger substructure 41 slidably fits (preferably tightly) and a hole 21 into which a finger snap fit protrusion 40 is releasably snappable. In another embodiment, flask holder assembly 8 further comprises non-contact sensor 18.

Referring again to FIGS. 3 and 4, an illustrative embodiment of base 12 is presented. The configuration and dimensions of base 12 are dictated by the size and shape of flask 10. The illustrated base 12 is an example of a preferred embodiment configured for holding a round Erlenmeyer type flask with a capacity of 250 milliliters (mL). In one embodiment, a plurality of bases are provided in a flask holder kit with different bases having different diameters (for example, measured along front to back symmetry line 36) in order to accommodate flasks having different diameters. In another embodiment, each base 12 in a flask holder kit is configured to accommodate flasks having one or more different diameters.

Figure 3:
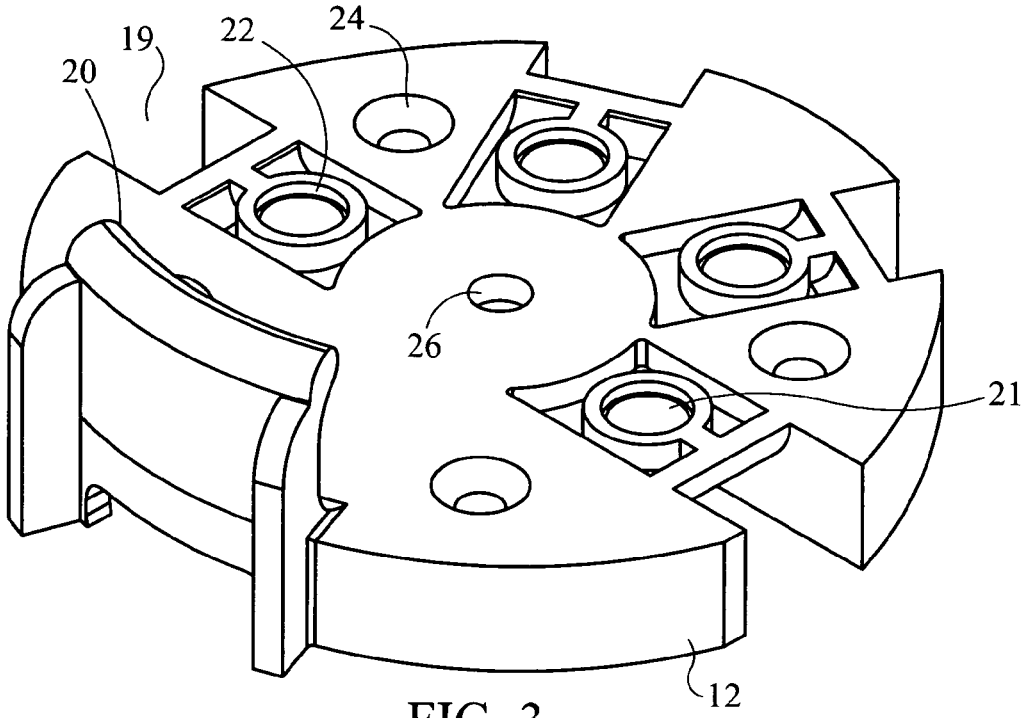
FIG. 3 is a perspective view of a flask holder base in accordance with an illustrative embodiment of the invention.
Figure 5:
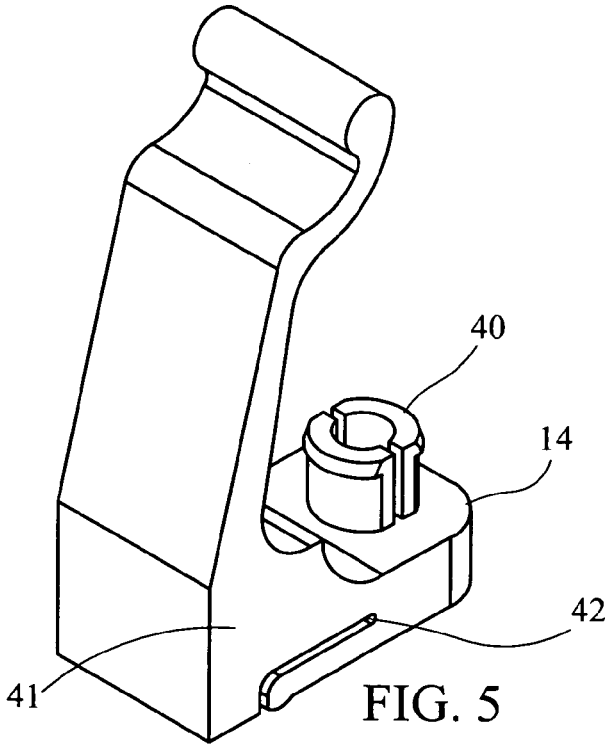
FIG. 5 is a perspective view of a flask holder finger in accordance with an illustrative embodiment of the invention.
Figure 4:
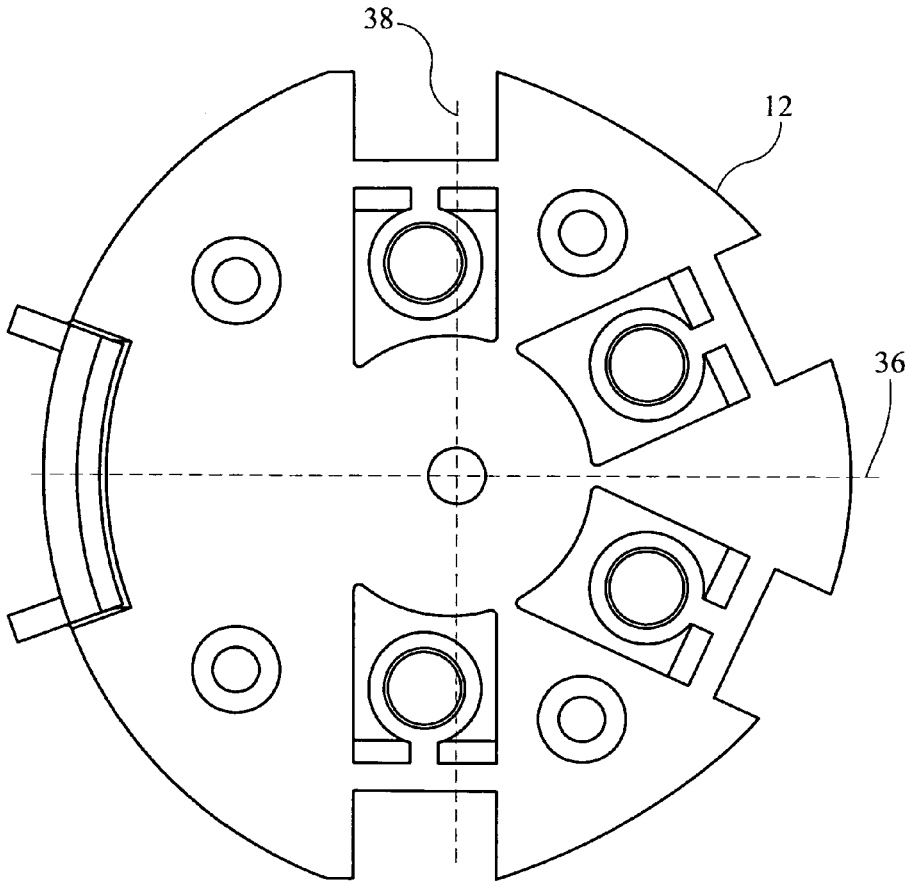
FIG. 4 is a plan (top) view of a flask holder base in accordance with an illustrative embodiment of the invention.

In this embodiment, base 12 comprises backstop 20, a plurality of finger attachment points 22, one or more base hold down attachment points 24 and sensor view port 26. In this embodiment, base 12 is removably attachable to a mixer 70 by means of screws that pass through one of more of the one or more base hold down attachment points and screw into threaded holes in a shaker table or mixer 70. Base 12 is preferably symmetrical along a first vertical plane indicated by front to back symmetry line 36. While finger attachment points may be finger-accepting holes into which individual fingers 14, 15 are snapped as shown in FIGS. 3 and 4, other conventional means of removably attaching fingers 14, 15 (e.g., attachment with a bolt) are also envisioned by the applicants. In another embodiment, base 8 has a single base hold down attachment point 24. In another embodiment, base 12 has no base hold down attachment point, the base being attached to mixer 70 by another conventional means (e.g., with a clamp).

Line 38 designates a second vertical plane. All finger attachment points 22 are preferably either situated to the right of the second vertical plane indicated by line 38 or have a feature that allows for the finger surface that contacts flask 10 to be parallel to the first vertical plane indicated by line 36. In some embodiments, the center of base 12 is located at the intersection of line 36 and line 38. In one embodiment, finger attachment points 22 are disposed along one or more circular or non-circular arcs. In another embodiment, the two finger attachment points 22 that are nearest backstop 20 (to which opposing side fingers 14 are attachable) are disposed at a different distance from the center of base 12 than are the other finger attachment points (to which forward fingers 15 are attachable). In another embodiment, each of the finger attachment points 22 or pairs of attachment points 22 are located at different distances from the center of base 12.

Backstop 20 is preferably substantially more rigid (for example, about 200 percent more rigid) when compared to more flexible fingers 14. In a more preferred embodiment, each of the fingers 14, 15 is provided with a snap fit protrusion 40 and is attached to base 12 with an interference fit, thus allowing for a finger design that is universal to all bases. Each snap fit protrusion 40 is provided with a slot allowing for a slight collapse of the snap fit protrusion 40 when installing or removing each of the fingers 14, 15 in base 12. In an illustrative embodiment, each of the fingers 14, 15 is provided with a substructure 41 having a relief slot 42 that facilitates its bending outward from the center of base 12 thus preventing undesired vibrations of the base when operated without a flask 10 in place. In a preferred embodiment, each substructure 41 is accommodated by a notch. In a preferred embodiment, configuring the fingers 14, 15 as independent parts (that are not integral with base 12) allows fingers to be added or removed as needed to provide greater or lesser flask retention force and/or greater or lesser flask insertion force. In another embodiment, protrusions 40 are provided on base 12 and each finger 14, 15 is provided with a hole 21 into which a protrusion 40 is snappable.

Figure 2:
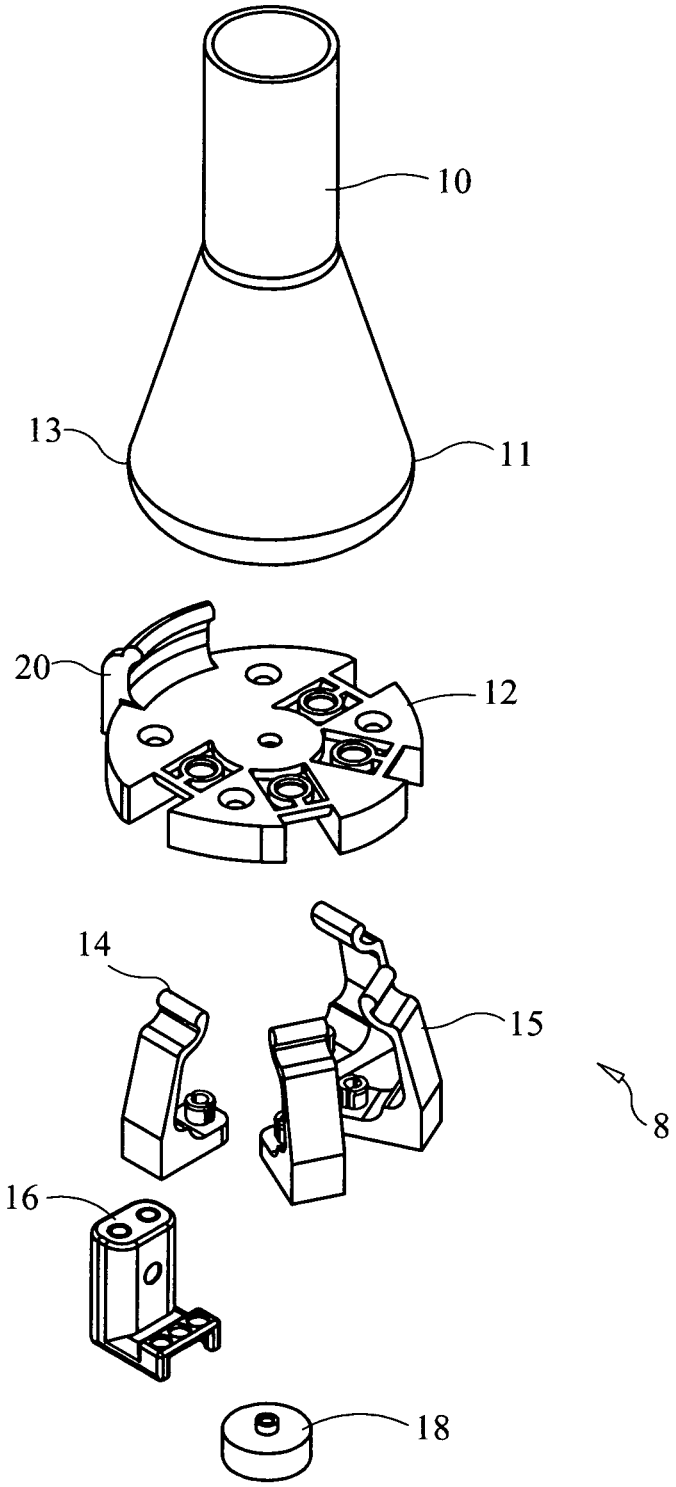
FIG. 2 is an exploded view of a flask and flask holder in accordance with another illustrative embodiment of the invention.

An additional feature of a preferred embodiment of flask holder assembly 8 is its ability to accept non-contact sensor 18. Sensor 18 is placed in flask holder 8 as shown in FIG. 2. Wires or optical fibers are then routed from sensor 18 through sensor interface 16 to associated instrumentation (not shown). At sensor interface 16, a bulkhead connector may be provided. The sensor 18 is preferably a non-contact device that provides data that characterizes the contents of vessel 10. The bulkhead connector provides a common connection point between flask holder 8 and the associated instrumentation. A wire or fiber optic cable extends from the sensor 18 and terminates on the flash holder 8. From that termination point, an extension may be provided to allow electrical or optical data to be transferred to the instrumentation. Examples of appropriate non-contact sensors 18 are those manufactured by PreSens Precision Sensing of Regensburg, Germany. In another embodiment, base 12 accommodates other sensor types, for example, one or more sensors that contact flask 10 or its contents.

Figure 6:
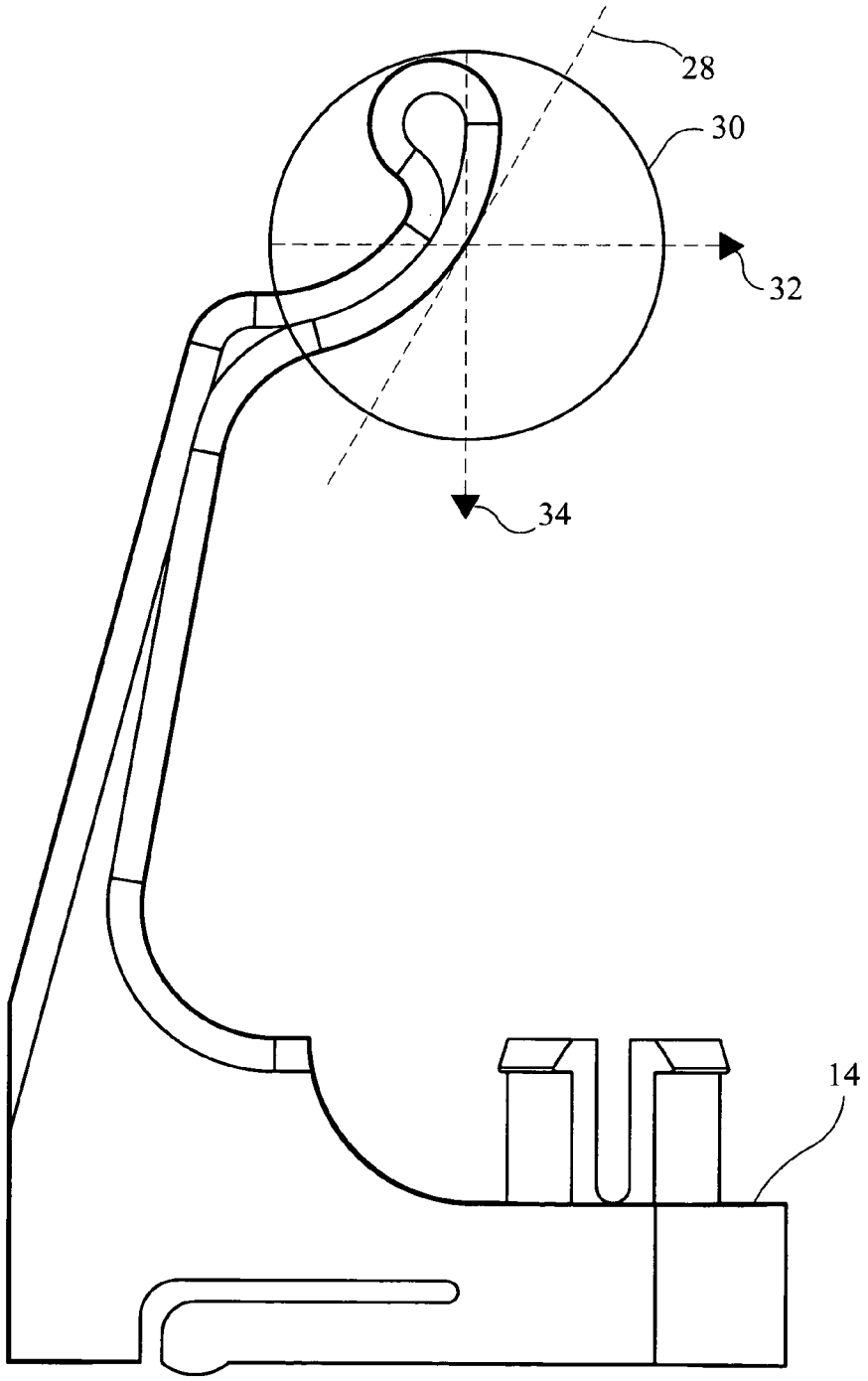
FIG. 6 is an elevation (side) view of a flask holder finger in accordance with an illustrative embodiment of the invention.

Referring again to FIGS. 5 and 6, a preferred embodiment of one of the fingers 14, 15 is presented. Schematically shown in FIG. 6 are vessel interface surface 28 of flask 10, finger/vessel contact point 30, the horizontal component 32 of the total force exerted on the vessel by the finger 14, 15 and the vertical component 34 of the total force exerted on the vessel by the finger 14, 15.

The total force that each of the fingers 14, 15 exerts on vessel 10 is a design feature determined by the thickness and material type used for finger 14, 15. The total force can be broken down into its horizontal and vertical components by knowing the angle of contact determined by the vessel geometry. In a preferred embodiment, the finger design is of a constant stress type (i.e., the stress is constant throughout the finger's cantilever). This type of design eliminates stress concentration points and allows for multiple vessel sizes to be more easily accommodated.

The structural design of flask holder 8 is based on two primary requirements. The first is an adequate vertical force component 34 and the second is a minimal installation force. In a vibratory application, the magnitude of required vertical force component 34 is determined by the weight of the vessel and its contents multiplied by the vertical acceleration. The vertical force components of all fingers 14, 15 must be greater than the force due to the vertical motion of the vessel. First, the total vertical force is divided by the number of fingers 14, 15 to be utilized and then the finger design is made to accommodate that force plus some factor of safety. Other factors contributing to the design of fingers 14, 15 are the fingers material, thickness and contact height. Factors such as the finger contact height are determined by the vessel geometry.

The second requirement, ease of installation, is dictated by human factors and the vessel material. Human factors require that an average person be capable of installing the vessel without undo exertion. This is a somewhat subjective requirement and is preferably established in consideration of the end user. The values are then balanced against the first requirement of an adequate vertical restraining force.

Figure 7:
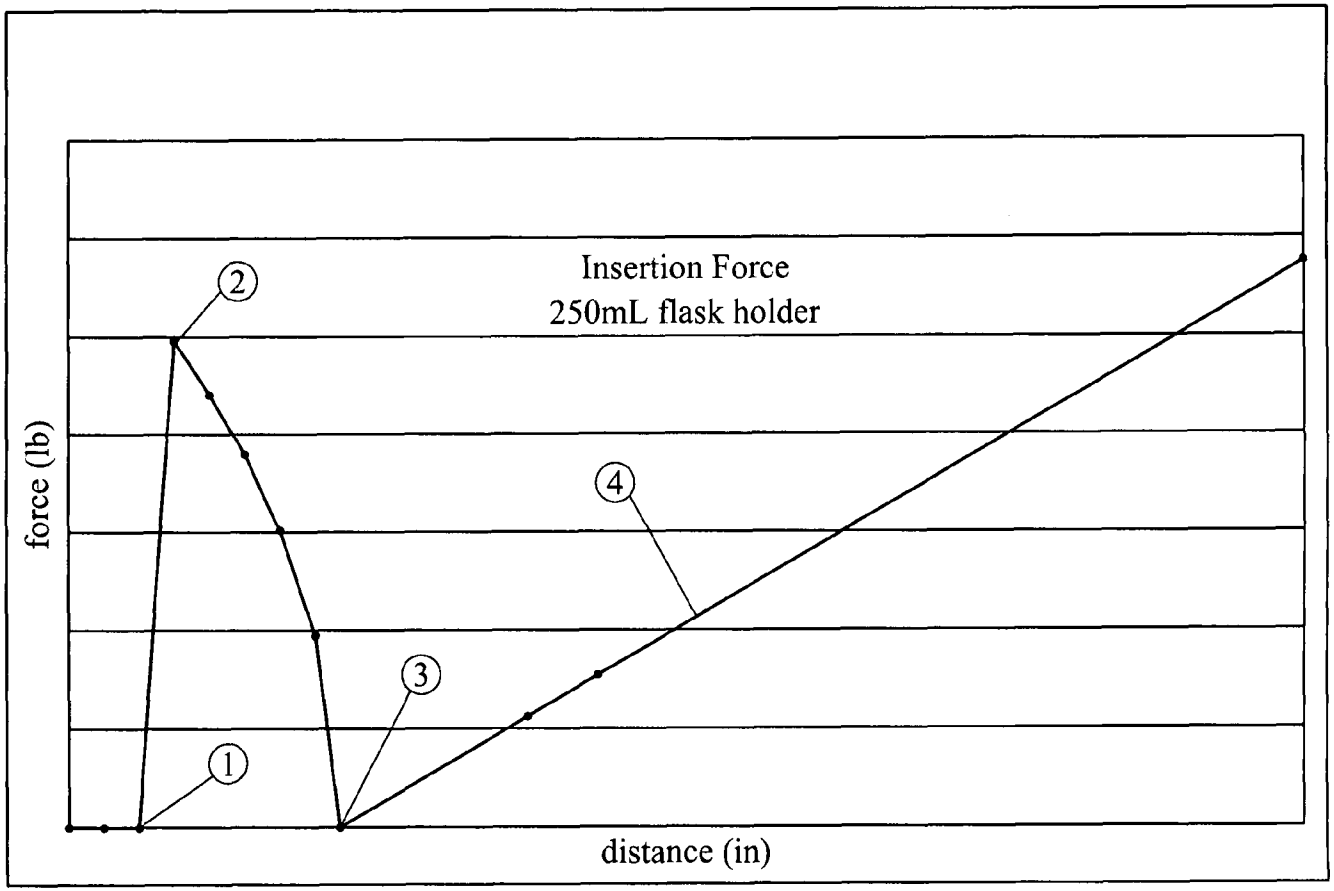
FIG. 7 is a graph of flask insertion force with distance into a flask holder finger in accordance with an illustrative embodiment of the invention.

Referring to FIG. 7, a plot is presented of vessel insertion force versus distance for insertion of a 250 mL vessel into an illustrative embodiment of flask holder assembly 8. The plot is for vessel 10 moving from left to right with flask holder assembly 8 situated on a horizontal surface with heel 20 on the left. At point 1, vessel 10 is just coming in contact with the flask holder's first two (left most) opposing fingers 14. From point 1 to point 2, vessel 10 is still only in contact with the first two opposing fingers 14. At point 2, vessel 10 is in contact with only two opposing fingers 14 and the force drops dramatically because the forces due to the finger's displacement are opposing and canceling each other. From point 3 forward, vessel 10 is coming into contact with the remaining forward fingers 15 so the force builds due to the displacement of forward fingers 15 as shown by line 4 in FIG. 7. When the vessel has cleared backstop 20, it is lowered onto base 12. Once this has been achieved, the operator removes his hand from the vessel and it is held securely in flask holder assembly 8.

Figure 8:
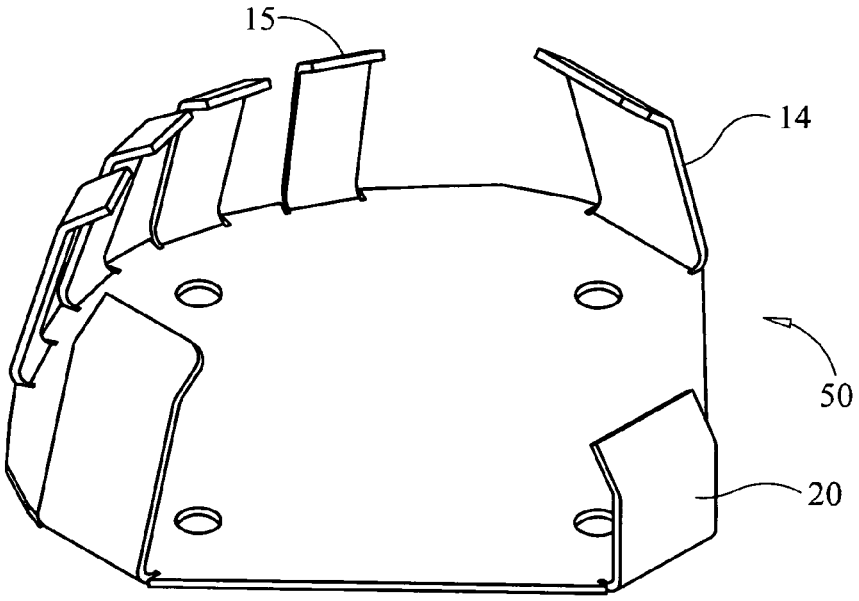
FIG. 8 is a perspective view of a one-piece metal flask holder in accordance with an alternative illustrative embodiment of the invention.

Referring to FIG. 8, an alternative illustrative embodiment of one-piece metal flask holder 50 is shown. Flask 10 is secured in a one-piece metal flask holder 50 by fingers 14 and backstop 20. In this embodiment, one-piece metal flask holder 5 is fabricated from stainless steel sheet metal.

Figure 9:
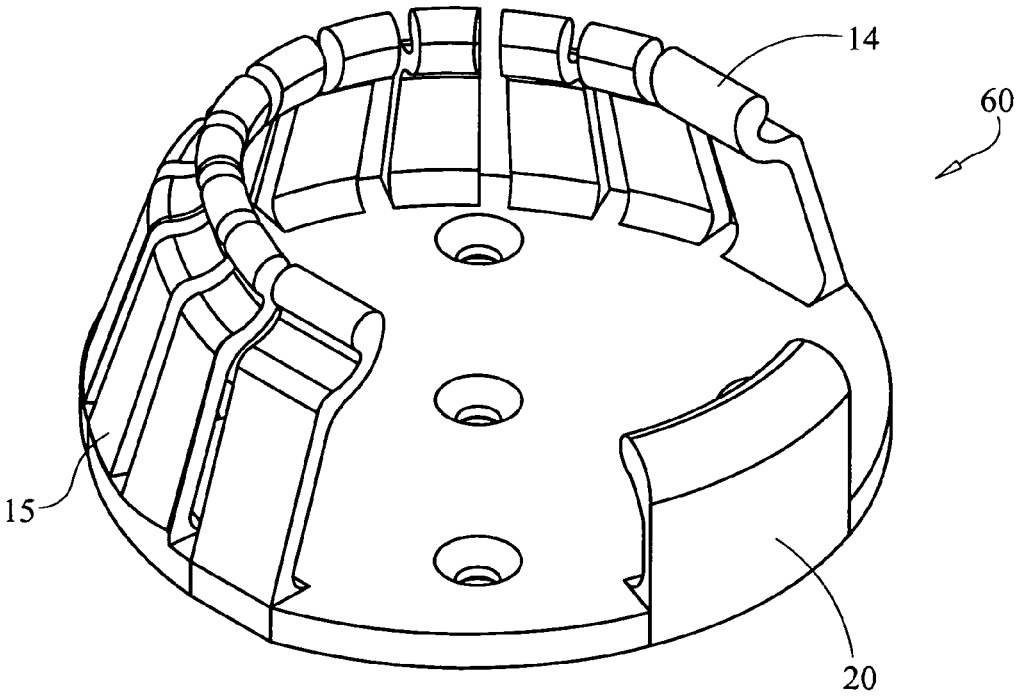
FIG. 9 is a perspective view of a one-piece plastic flask holder in accordance with an alternative illustrative embodiment of the invention.

Referring to FIG. 9, another alternative illustrative embodiment of one-piece plastic flask holder 60 is shown. Flask 10 is secured in a one-piece plastic flask holder 60 by fingers 14 and backstop 20. In this embodiment, one-piece plastic flask holder 60 is injection molded using a thermoplastic.

Figure 10:
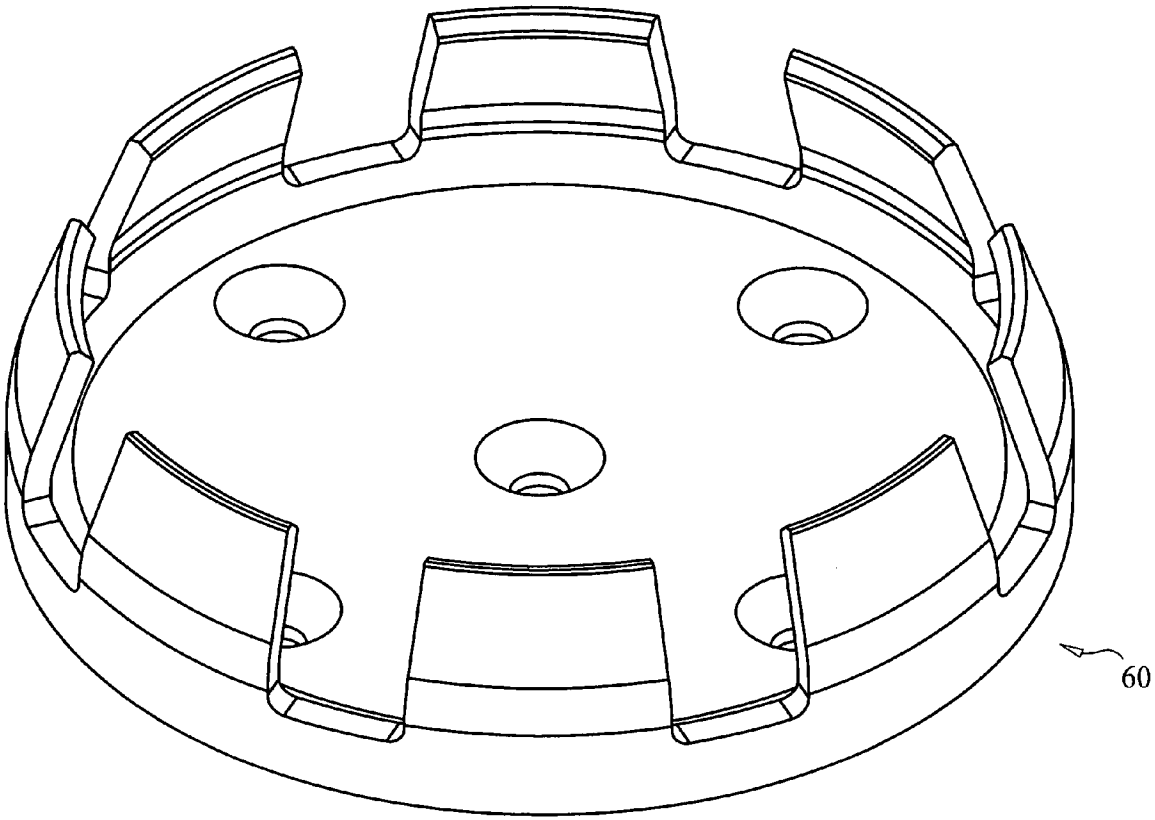
FIG. 10 is a perspective view of another alternative illustrative embodiment of the invention.

Another alternative embodiment of the invention is shown in FIG. 10. This embodiment requires that containers of a specific size be utilized, but allows insertion at multiple angles of approach. In this embodiment, side fingers 14 may not oppose one another and all fingers 14, 15 may have the same dimensions and shape and are integral to holder 8.

Figure 11:
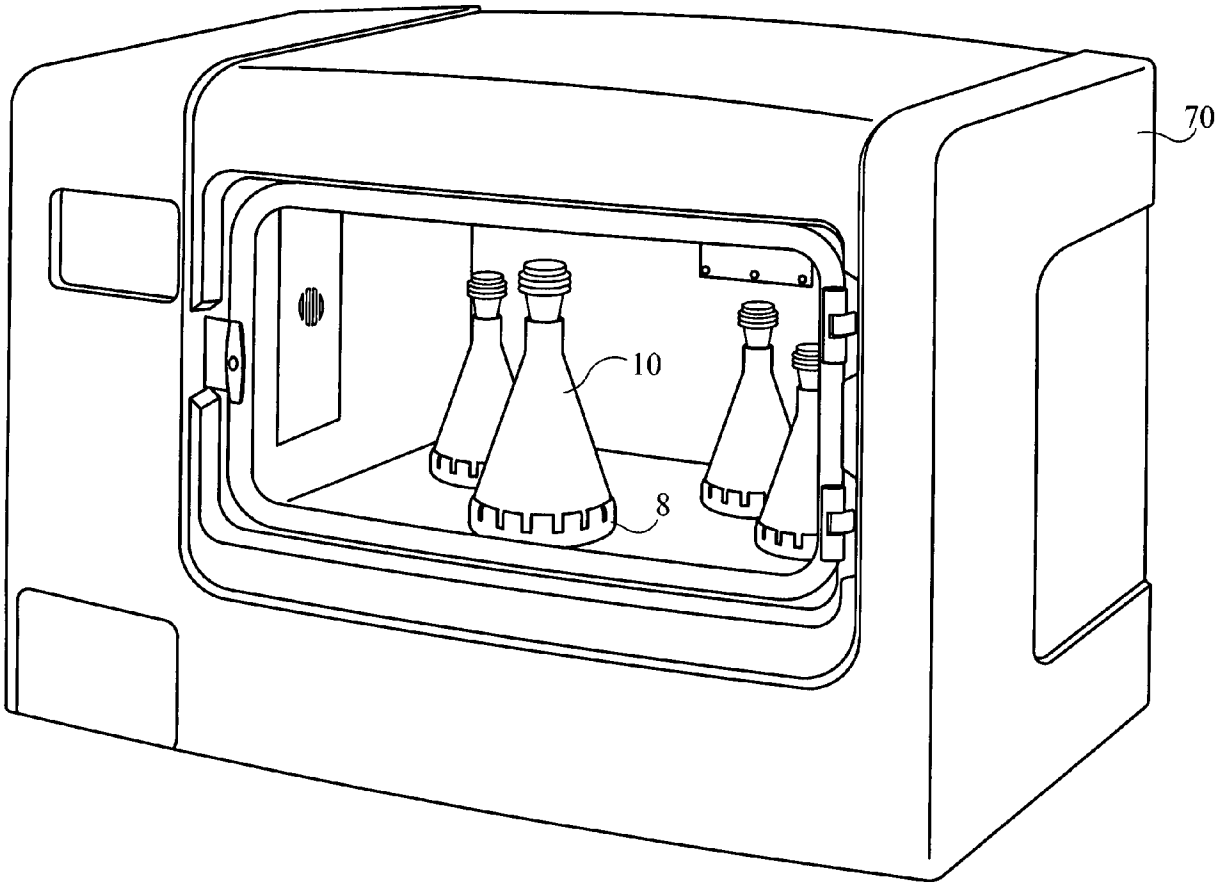
FIG. 11 is a perspective view of a flask holder mounted on a mixer in accordance with an illustrative embodiment of the invention.

Referring to FIG. 11, flask holder 8 is shown mounted in mixer 70. While the illustrated mixer 70 is a vibratory mixer, the applicants envision flask holder 8 being used with a wide variety of mixers and shaker tables.

Illustrative embodiments of the invention are designed such that they meet specific environmental requirements. In some applications, the invention would have to possess temperature capabilities from 20 degrees Centigrade (° C.) to 80° C. and humidity to 100 percent. Use with aggressive mixers requires the invention to retain containers in mixers that can impose to up to 50 times the acceleration due to gravity (Gs) of vertical acceleration over a mixer oscillating frequency range of 30 to 100 Hertz (Hz). Off-axis vertical accelerations may reach 25 Gs at similar frequencies.

In an illustrative embodiment, flask holder 8 is constructed of a low water absorption polymer, for example by machining or injection molding. In another embodiment, flask holder 8 is constructed of ULTEM® polyetherimide plastic. In yet another embodiment, flask holder 8 is constructed of polycarbonate. In yet another embodiment, flask holder 8 is constructed of acrylic. In yet another embodiment, flask holder 8 is constructed of a high performance plastic. In yet another embodiment, flask holder 8 is constructed of a plastic with temperature capabilities of 20° C. to 80° C. In yet another embodiment, flask holder 8 is constructed of a plastic with low creep characteristics.

Illustrative embodiments are designed such that non-intrusive sensor 18 may be used to monitor the condition of the contents of vessel 10, thus allowing for the further optimization of the mixing process. It will be appreciated that the implementation of the non-intrusive sensor may be added directly to the holder component or applied via an additional sub-base component.

Multiple sensing elements 18 may be incorporated into flask holder assembly 8 by either placing them in concentric rings within base 12 or by placing them at strategic locations on base 12. The concentric ring configuration is particularly useful in round shaped vessel as the need for indexing the vessel to a particular location is eliminated.

In an illustrative embodiment, flask holder 8 comprises on-board mechanical, optical, and/or electrical components supporting the use one or more non-intrusive sensors 18. These components may include optical fibers, connectors, prisms, mirrors or wireless transmitters built into the holder. In another illustrative embodiment, flask holder 8 comprises a mechanism by which onboard electrical power is generated through the conversion of mechanical energy supplied by the agitation mechanism for use by the on-board components. In another illustrative embodiment, flask holder 8 comprises a mechanism by which attached fibers or cables are provided with strain relief to prevent damage during agitation motions with a significant vertical component. In another illustrative embodiment, sensor view ports 26 and/or sensors 18 are placed in one or more concentric rings to eliminate the need for precise flask placement on flask holder 8.

In preferred embodiments, elements of the invention are provided as a kit. In this embodiment, flask holder 8 is designed to be configured differently (the number of fingers utilized may be modified by the user) to accommodate different flask sizes and for operation at different levels of vibratory force. The applicants discovered that an innovative approach was necessary to achieve three primary goals: (1) one-handed operation, (2) a strong holding force at the high accelerations produced by commercially-available mixers and (3) an ability to accommodate multiple (different) flask sizes and geometries that are produced by different flask vendors.

In some preferred embodiment, the invention provides the ability (by allowing the user to choose how many of the fingers to snap in) to modulate the ratio between insertion force and holding (retention) force. For example, if one is running the mixer at moderate levels of force, and desires a very low level of insertion force to accommodate a user with hands that are not as strong as those of other users, then some of fingers 14, 15 may be removed from holder 8 to accomplish this goal. Moreover, if an unusual flask geometry is encountered (with a flask being slightly wider than normal, for example), then several fingers may be removed in order to allow this flask to be inserted. This is advantageous in situations in which, if all fingers remained in place, it would not be possible to insert flask 10 into flask holder 8 with a reasonable amount of force.

In preferred embodiments, fingers 14, 15 are designed to be mixed and matched across an entire range of flask holder models (for example, the same finger design is used in 250 mL, 500 mL and 1000 mL holder models, which may have different base 12 dimensions). This offers significant advantages to the user, in that the user is able to mix and match fingers among different holder models, and for ease-of-replacement purposes. Thus, the same sized fingers may be used to accommodate different size flasks in the individual flask holder models.

Many variations of the invention will occur to those skilled in the art. Some variations include a one-piece flask holder. Other variations call for a multiple-piece flask holder assembly. All such variations are intended to be within the scope and spirit of the invention.

Although some embodiments are shown to include certain features or steps, the applicants specifically contemplate that any feature or step disclosed herein may be used together or in combination with any other feature or step on any embodiment of the invention. It is also contemplated that any feature or step may be specifically excluded from any embodiment of the invention.

What is claimed is:

1. An apparatus for holding an Erlenmeyer flask, said apparatus comprising:

a base that is adapted for temporary attachment to an oscillatory mixer, said base having a substantially planar upper surface, a plurality of finger attachment points, a plurality of base hold down attachment points, a sensor view port and a front to back symmetry line;

a backstop that is fixed to said base, said backstop extending a first distance above said base;

two opposing side fingers, each of said opposing side fingers extending a second distance above said base that is greater than said first distance and comprising a side finger snap fit protrusion which is adapted for snapping into and removal from said base at either of said finger attachment points that is located nearest to said backstop and each of said opposing side fingers comprising a surface that is disposed substantially parallel to said front to back symmetry line when said two opposing side fingers are removably attached to said base;

a plurality of forward fingers, each of said forward fingers extending said second distance above said base and comprising a forward finger snap fit protrusion that is adapted for snapping into and removal from said base at another of said finger attachment points, none of said forward fingers being disposed symmetrically on the opposite side of said front to back symmetry line from another finger;

a non-contact sensor that is mounted in said base under said sensor view port; and a sensor interface that is operatively connected to said non-contact sensor and that is mounted on said base;

wherein said backstop, said opposing side fingers, and said forward fingers are operative to resist forces associated with said oscillatory mixer's imposing a vertical acceleration in the range from about 5 Gs to about 50 Gs on the Erlenmeyer flask.

2. The apparatus of claim 1 wherein said opposing side fingers and said forward fingers are interchangeable.

3. The apparatus of claim 1 wherein said opposing side fingers and said forward fingers have the same dimensions and shape.

4. The apparatus of claim 1 wherein said non-contact sensor is an optical sensor.

5. The apparatus of claim 1 wherein said backstop is integral with said base.

6. The apparatus of claim 1 wherein said base, said backstop, said two opposing fingers and said forward fingers are fabricated or molded from plastic.

7. The apparatus of claim 1 wherein each of said fingers further comprises a substructure and each of said finger attachment points comprises a hole into which one of said snap fit protrusions is removably snappable and a notch which accommodates said substructure.

8. The apparatus of claim 1 wherein said base, said backstop, said two opposing side fingers and said plurality of forward fingers are metal.

9. The apparatus of claim 1 wherein said base, said backstop, said two opposing side fingers and said plurality of forward fingers are plastic.

10. An apparatus for securing a flask, said apparatus comprising:

a base that is adapted for temporary attachment to an oscillatory mixer, said base having a substantially planar upper surface, a plurality of finger attachment points, a plurality of base hold down attachment points, a sensor view port and a front to back symmetry line;

a backstop that is fixed to said base, said backstop extending a first distance above said base;

two opposing side fingers, each of said opposing side fingers comprising a side finger snap fit protrusion which is adapted for removable attachment to said base at either of said finger attachment points that is located nearest to said backstop and each of said opposing side fingers extending a second distance above said base that is more than said first distance and comprising a surface that is disposed substantially parallel to said front to back symmetry line when said two opposing side fingers are removably attached to said base; and one or more forward fingers, each of said forward fingers extending a third distance above said base that is more than said first distance and comprising a forward finger snap fit protrusion that is adapted for removable attachment to said base at another of said finger attachment points;

wherein said backstop, side fingers, and forward fingers are operative to allow manual insertion of the flask into the apparatus and to resist forces associated with said oscillatory mixer's imposing a vertical acceleration in the range from about 5 Gs to about 50 Gs on the inserted flask.

11. The apparatus of claim 10 further comprising:

a non-contact sensor that is attachably mounted in said base under said sensor view port.

12. The apparatus of claim 11 further comprising:

a sensor interface that is operatively connected to said non-contact sensor and that is mounted on said base.

13. An apparatus for mixing the contents of an Erlenmeyer flask, said apparatus comprising:

an oscillatory mixer;

a base that is adapted for temporary attachment to said oscillatory mixer, said base having a substantially planar upper surface, a plurality of finger attachment points, a plurality of base hold down attachment points, a sensor view port and a front to back symmetry line;

a backstop that is fixed to said base, said backstop extending a first distance above said base;

two opposing side fingers, each of said opposing side fingers comprising a side finger snap fit protrusion which is adapted for snapping into said base at either of said finger attachment points that is located nearest to said backstop and each of said opposing side fingers comprising a surface that is disposed substantially parallel to said front to back symmetry line when said two opposing side fingers are attached to said base;

a plurality of forward fingers, each of said forward fingers extending a second distance above said base that is greater than said first distance and comprising a forward finger snap fit protrusion that is adapted for snapping into said base at another of said finger attachment points;

a non-contact sensor that is mounted in said base under said sensor view port; and a sensor interface that is operatively connected to said non-contact sensor and that is mounted on said base;

wherein said backstop, said opposing side fingers, and said forward fingers are operative to secure the Erlenmeyer flask to said base and to resist forces associated with said oscillatory mixer's imposing a vertical acceleration in the range from about 5 Gs to about 50 Gs on the Erlenmeyer flask.

14. The apparatus of claim 13 wherein said opposing side fingers and said forward fingers are interchangeable.

15. The apparatus of claim 13 wherein said opposing side fingers and said forward fingers have the same dimensions and shape.

16. The apparatus of claim 13 wherein said non-contact sensor is an optical sensor.

17. The apparatus of claim 13 wherein said backstop is integral with said base.

18. The apparatus of claim 13 wherein said base, said backstop, said two opposing fingers and said forward fingers are fabricated or molded from plastic.

19. The apparatus of claim 13 wherein each of said fingers further comprises a substructure and each of said finger attachment points comprises a hole into which one of said snap fit protrusions is snappable and a notch which accommodates said substructure.

20. The apparatus of claim 13 wherein said base, said backstop, said two opposing side fingers and said plurality of forward fingers are metal.

21. The apparatus of claim 13 wherein said base, said backstop, said two opposing side fingers and said plurality of forward fingers are plastic.

22. An apparatus for mixing the contents of a flask, said apparatus comprising:

an oscillatory mixer;

a base that is adapted for temporary attachment to said oscillatory mixer, said base having a substantially planar upper surface, a plurality of finger attachment points, a plurality of base hold down attachment points, a sensor view port and a front to back symmetry line;

a backstop that is fixed to said base, said backstop extending a first distance above said base;

two opposing side fingers, each of said opposing side fingers extending a second distance above said base that is greater than said first distance and comprising a side finger snap fit protrusion which is adapted for snapping into said base at either of said finger attachment points that is located nearest to said backstop and each of said opposing side fingers comprising a surface that is disposed substantially parallel to said front to back symmetry line when said two opposing side fingers are attached to said base; and one or more forward fingers, each of said forward fingers comprising a forward finger snap fit protrusion that is adapted for snapping into said base at another of said finger attachment points;

wherein said backstop, side fingers, and forward fingers are operative to allow manual insertion of the flask into the apparatus and to resist forces associated with said oscillatory mixer's imposing a vertical acceleration in the range from about 5 Gs to about 50 Gs on the inserted flask.

23. The apparatus of claim 22 further comprising:

a non-contact sensor that is attachably mounted in said base under said sensor view port.

24. The apparatus of claim 23 further comprising:

a sensor interface that is operatively connected to said non-contact sensor and that is mounted on said base.

* * * * *